US011524857B2

(12) United States Patent
Murayama

(10) Patent No.: US 11,524,857 B2
(45) Date of Patent: Dec. 13, 2022

(54) ADHESIVE BONDING OF TRAY FOR IMAGE FORMING APPARATUS

(71) Applicant: CANON KABUSHIKI KAISHA, Tokyo (JP)

(72) Inventor: Shigeo Murayama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 17/352,048

(22) Filed: Jun. 18, 2021

(65) Prior Publication Data

US 2021/0403264 A1 Dec. 30, 2021

(30) Foreign Application Priority Data

Jun. 29, 2020 (JP) ..... JP2020-111973

(51) Int. Cl.

| | |
|---|---|
| ***B65H 11/02*** | (2006.01) |
| ***G03G 15/00*** | (2006.01) |
| *B65H 1/04* | (2006.01) |

(52) U.S. Cl.

CPC ..... *B65H 11/02* (2013.01); *G03G 15/6514* (2013.01); *B65H 1/04* (2013.01); *B65H 2402/45* (2013.01); *B65H 2402/60* (2013.01); *B65H 2402/80* (2013.01); *B65H 2405/111* (2013.01); *B65H 2405/324* (2013.01); *B65H 2407/21* (2013.01); *B65H 2801/06* (2013.01)

(58) Field of Classification Search

CPC ..... B65H 2402/61; B65H 2402/80; B65H 2405/324; B65H 2407/21; B65H 2405/111; B65H 11/02; B65H 2402/45; B65H 2801/06; G03G 15/6514

See application file for complete search history.

(56) References Cited

U.S. PATENT DOCUMENTS 11,281,148 B2 * 3/2022 Seto ..... G03G 21/1619

FOREIGN PATENT DOCUMENTS

| | | |
|---|---|---|
| JP | 2007-031042 A | 2/2007 |
| JP | 2010-025960 A | 2/2010 |
| JP | 2010-102124 A | 5/2010 |

* cited by examiner

*Primary Examiner* — Jeremy R Severson
(74) *Attorney, Agent, or Firm* — Canon U.S.A., Inc. I.P. Division

(57) ABSTRACT

An image forming apparatus includes a main body including an image forming unit to form an image on a recording medium and a tray that rotates between an open state and a closed state relative to the main body, the tray on which the recording medium is placed. The tray includes a first component located exterior to the image forming apparatus in the closed state and a second component in contact with the recording medium on the tray in the open state. The first or second component includes at least one groove portion which extends in a conveyance direction of the recording medium and the other includes at least one convex portion extending in the conveyance direction. The first and second components are bonded by adhering, with an adhesive, the at least one groove portion and the at least one convex portion put inside the at least one groove portion.

13 Claims, 8 Drawing Sheets

[BEFORE ENGAGEMENT]

[AFTER ENGAGEMENT]

[BEFORE ENGAGEMENT] [AFTER ENGAGEMENT]

[BEFORE ENGAGEMENT] [AFTER ENGAGEMENT]

ADHESIVE BONDING OF TRAY FOR IMAGE FORMING APPARATUS

BACKGROUND

Field

The present disclosure relates to the configuration of trays provided to image forming apparatuses.

Description of the Related Art

There is a known configuration of a sheet feed tray openable and closable to the main body of an image forming apparatus (Japanese Patent Application Laid-Open No. 2010-102124). To form images on predetermined recording media, the sheet feed tray is opened from the main body of the image forming apparatus, some recording media are set on the sheet feed tray, and each recording medium on the sheet feed tray is supplied to the main body. As described above, a configuration is provided in which images are formed on recording media easily set on a sheet feed tray on an image forming apparatus.

There is a recently increasing demand for high ingenious design of image forming apparatuses. To respond to the demand, trays such as a sheet feed tray are designed to support the weight of recording media put on the surface of a tray. On the other hand, the tray is composed of a conveyance cover that constitutes the surface on which recording media are put and an exterior cover that constitutes a part of the exterior subjected to gloss processing and embossed processing.

Further, to respond to the demand for a smaller and lighter image forming apparatus, the tray rotatable with respect to the main body is designed in consideration of getting thinner to keep the size of the image forming apparatus with the sheet feed tray closed and put in the image forming apparatus in place.

However, some thinned trays each formed by a conveyance cover and an exterior cover being superimposed on each other have a decreased rigidity, causing easy bending or rattling of the tray, resulting in worse operability and texture of the tray.

SUMMARY

The present disclosure is directed to the provision of an image forming apparatus equipped with a tray with less decrease in rigidity without causing worse texture of the tray and a manufacturing method of the image forming apparatus.

According to an aspect of the present disclosure, an image forming apparatus includes a main body including an image forming unit configured to form an image on a recording medium, and a tray configured to rotate between an open state and a closed state with respect to the main body, the tray on which the recording medium is placed wherein the tray includes a first component as a part of an exterior of the image forming apparatus in the closed state and a second component configured to be in contact with the recording medium placed on the tray in the open state, wherein one of the first component and the second component includes at least one groove portion which extends in a conveyance direction of the recording medium and the other of the first component and the second component includes at least one convex portion which extends in the conveyance direction, wherein the first component and the second component are bonded by adhering, with an adhesive, the at least one convex portion, which is put inside the at least one groove portion and the at least one groove portion.

According to another aspect of the present disclosure, a method of manufacturing an image forming apparatus includes applying an adhesive to an inside of a groove portion included in a first component and extending in a predetermined direction, manufacturing a tray by inserting a convex portion included in a second component and extending in the predetermined direction into the groove portion and bonding the groove portion and the convex portion by an adhesive, the tray on which a recording media is placed, and attaching the tray to a main body including an image forming unit configured to form an image on the recording medium. The predetermined direction is a conveyance direction of the recording medium in a state in which the tray is attached to the main body.

Further features of the present disclosure will become apparent from the following description of exemplary embodiments with reference to the attached drawings.

DESCRIPTION OF THE EMBODIMENTS

Figure 1A:
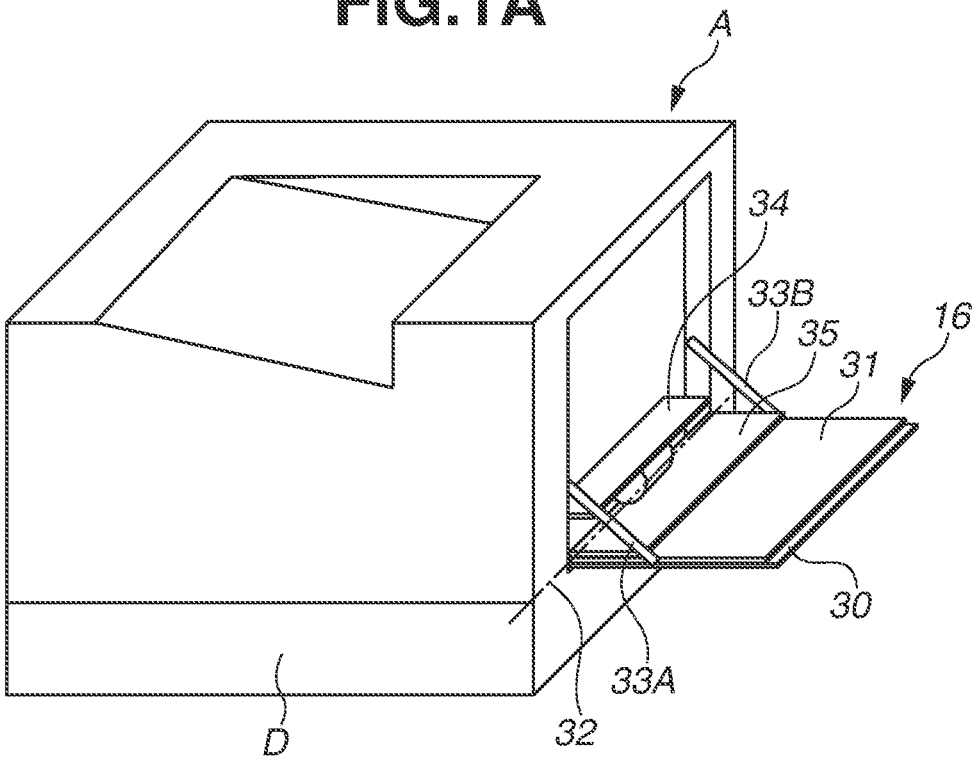
FIGS. 1A and 1B are schematic perspective views of a printer.
Figure 1B:
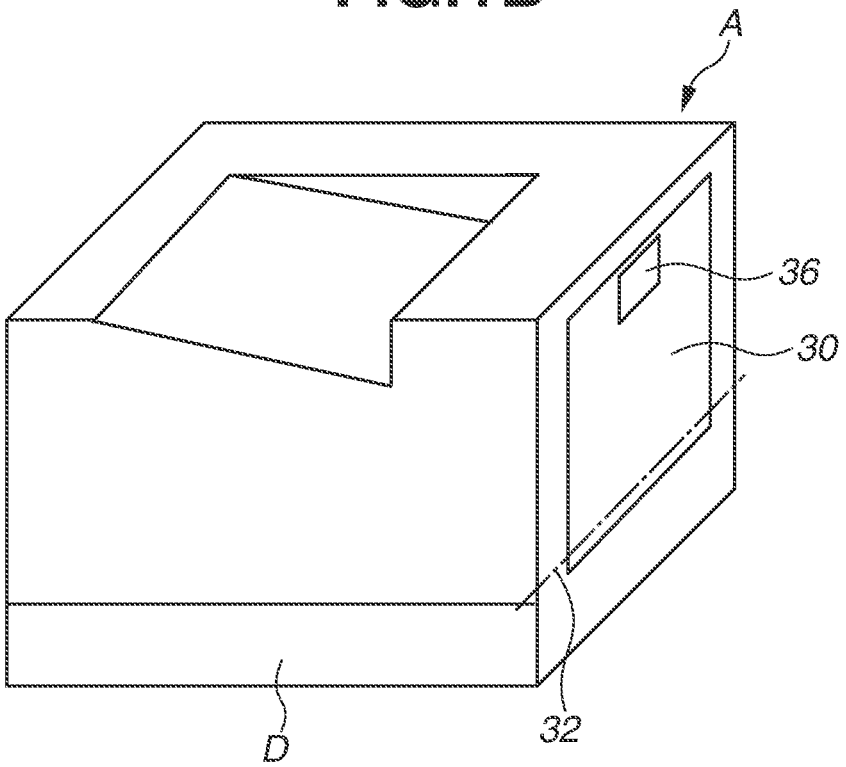
Figure 2:
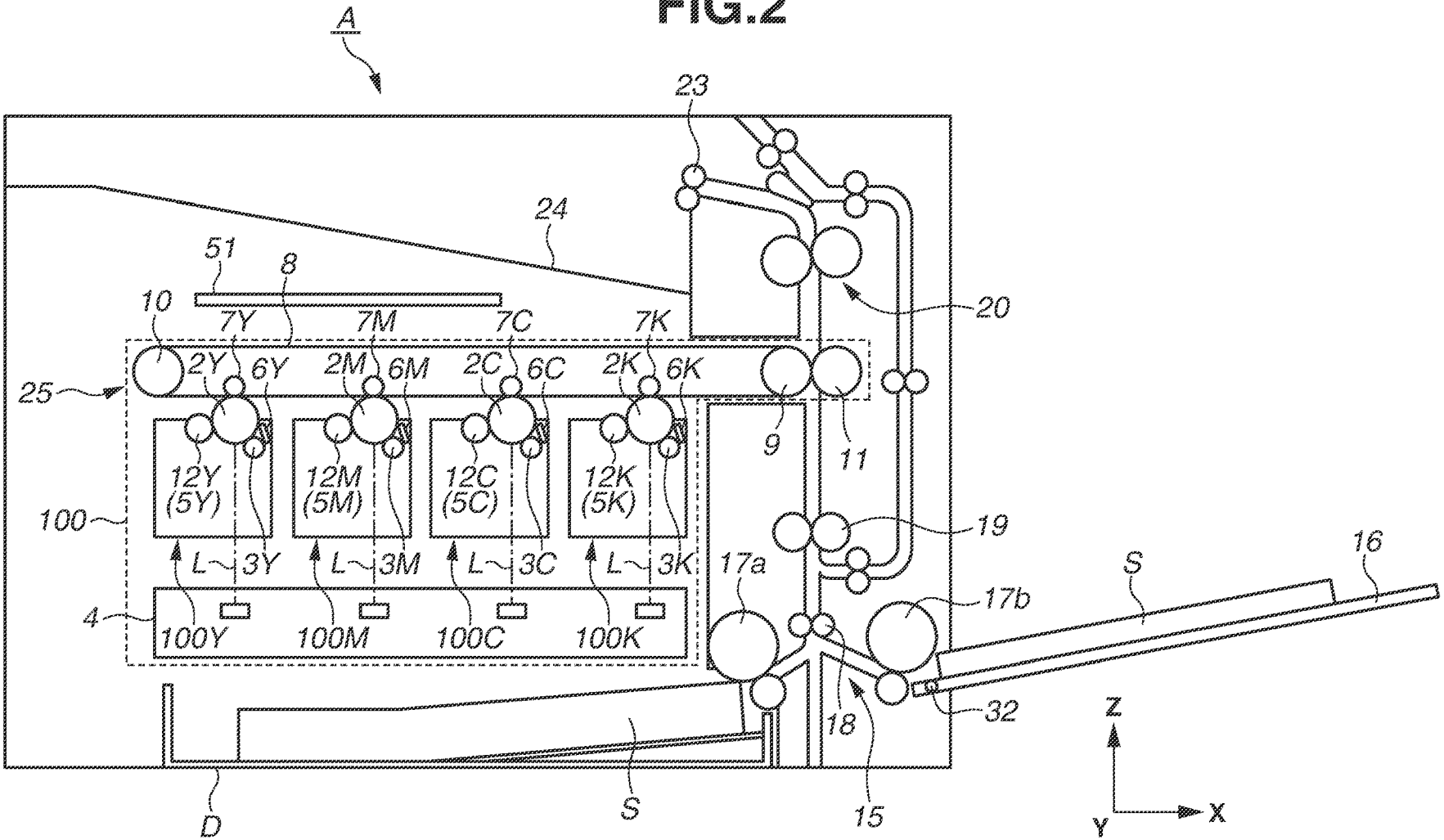
FIG. 2 is a schematic cross-sectional view of the printer.

A configuration of an image forming apparatus according to a first exemplary embodiment will be described with reference to FIGS. 1A, 1B, and 2. FIGS. 1A and 1B are schematic perspective views of the image forming apparatus. FIG. 2 is a schematic cross-sectional view of the image forming apparatus. According to the present exemplary embodiment, a printer A employing an electrophotographic method will be described as the image forming apparatus, but the image forming apparatus is not limited to that. The image forming apparatus may be an ink-jet printer or a multifunction peripheral further including an image reading unit.

Unless otherwise specified, the sizes, materials, configurations, and relative arrangement of components set forth in the below-described exemplary embodiments are not intended to limit the scope of the present disclosure.

<Image Forming Operation>

The printer A according to the present exemplary embodiment is an electrophotographic image forming apparatus. The printer A transfers four color toners, yellow Y, magenta M, cyan C, and black K to an intermediate transfer belt and then transfers toner images to a recording medium S, such as a paper sheet, to form an image thereon. In the following descriptions, each of the letters Y, M, C, and K is added to the corresponding members relevant to the toner. However, a configuration and an operation of each type of member described with the letters are substantially the same but different in toner color. For this reason, the letters will be omitted unless the member is distinguished between toner colors.

The printer A includes a cassette D, an image forming unit 100, a recording medium supply unit 15, and a fixing unit 20 (FIG. 2). The cassette D stores recording media S such as paper sheets. The image forming unit 100 lies over the cassette D and forms toner images on recording media S. The recording medium supply unit 15 feeds recording media S. The fixing unit 20 fixes toner images on recording media S.

The image forming unit 100 includes photosensitive drums 2 (2Y, 2M, 2C, and 2K) as photosensitive members, charging rollers 3 (3Y, 3M, 3C, and 3K) as charging units for charging the surfaces of the photosensitive drums 2, and development devices 5 (5Y, 5M, 5C, and 5K) as development units. The image forming unit 100 further includes primary transfer rollers 7 (7Y, 7M, 7C, and 7K) as transfer units, a laser scanner unit 4 as an exposure unit, cleaning blades 6 (6Y, 6M, 6C, and 6K), and an intermediate transfer unit 25. The intermediate transfer unit 25 includes an intermediate transfer belt 8, a secondary transfer roller 11, a secondary transfer counter roller 9, and a tension roller 10. The intermediate transfer belt 8 is an endless belt stretched on the secondary transfer counter roller 9 and the tension roller 10.

Next, the recording medium supply unit 15 will be described. The recording medium supply unit 15 includes a feeding roller pair 17, a conveyance roller pair 18, and a registration roller pair 19 to convey recording media S in the cassette D or on the sheet feed tray 16 below the image forming unit 100. The recording medium supply unit 15 further includes a sheet feed unit 34 and an intermediate plate 35 (FIG. 1A). The sheet feed unit 34 conveys each of the recording media S on the sheet feed tray to the image forming unit. Each of the recording media S on the sheet feed tray 16 is transferred via the intermediate plate 35 to the sheet feed unit 34. The feeding roller pair 17 includes a feeding roller pair 17*a* for feeding recording media S stored in the cassette D and a feeding roller pair 17*b* for feeding recording media S on the sheet feed tray 16.

The sheet feed tray 16 is rotatable with respect to the main body of the printer A. Specifically, with the sheet feed tray 16 closed and put in the main body of the printer A in place (FIG. 1B), the sheet feed tray 16 is openable for recording media to be put thereon (FIG. 1A).

Pressing a lock lever 36 in the sheet feed tray 16 put in the main body of the image forming apparats 1 in place causes a lock on the main body of the image forming apparatus 1 to be released, allowing the sheet feed tray 16 to be movable. The sheet feed tray 16 is rotatable with respect to the image forming apparatus 1 about a rotating shaft 32 provided vertically lower at one end of the sheet feed tray 16 so that the other end of the sheet feed tray 16 located vertically upper is away from the main body of the image forming apparatus 1. The sheet feed tray 16 is provided with links 33A and 33B at both ends in the extending direction of the rotating shaft 32. The links 33A and 33B prevents the sheet feed tray 16 from rotating after the sheet feed tray 16 is opened with a predetermined angle with respect to the image forming apparatus 1. The sheet feed tray 16 opened with the predetermined angle with respect to the image forming apparatus 1 allows recording media S to be placed on the sheet feed tray 16.

The intermediate plate 35 is provided with a pair of sheet width regulating plates (not illustrated). The pair of the sheet width regulating plates positions recording media S in the sheet width direction perpendicular to the conveyance direction of the recording media S on the sheet feed tray 16 according to the size of the recording media S put on the sheet feed tray 16. Specifically, the pair of the sheet width regulating plates has a configuration such as a rack-and-pinion mechanism to move with each other to position recording media S at a predetermined position in the sheet width direction of the recording media S.

While the sheet feed tray 16 is opened at a predetermined angle with respect to the image forming apparatus 1 for recording media S to be put thereon, the sheet feed tray 16 is rotatable about the rotating shaft 32 so that the other end of the sheet feed tray 16 approaches the main body of the image forming apparatus 1. With the sheet feed tray 16 put in the main body of the image forming apparatus 1 in place, the sheet feed tray 16 is locked on the main body of the image forming apparatus 1 and prevented from rotating.

Next, an image forming operation involving a sheet conveyance operation will be described. First, in response to a reception of a print job signal by a control unit (not illustrated), the recording medium supply unit 15 starts to be driven. With the sheet feed tray 16 opened and a recording medium S ready to be put on the sheet feed tray 16, the recording medium supply unit 15 drives the feeding roller pair 17*b* to convey the recording medium S on the sheet feed tray 16. On the other hand, with the sheet feed tray 16 put in the printer A in place, the recording medium supply unit 15 drives the feeding roller pair 17*a* to feed a recording medium S in the cassette D. As described above, the recording medium supply unit 15 sends the recording medium S to a secondary transfer unit in which the secondary transfer roller 11 and the secondary transfer counter roller 9 face each other across the intermediate transfer belt 8.

In the image forming unit 100, charging biases applied to the charging rollers 3 charge the surfaces of the photosensitive drums 2 uniformly. Then, the laser scanner unit 4 irradiates the surfaces of the photosensitive drums 2 of the colors with laser beams L according to image data transmitted from an external apparatus (not illustrated). The laser scanner unit 4 exposes the photosensitive drums 2 to the laser beams L as described above, forming electrostatic latent images on the surfaces of the photosensitive drums 2.

Then, developing biases are applied to developing rollers 12 (12Y, 12M, 12C, and 12K) included in the development devices 5. Each color toner adheres to the corresponding electrostatic latent image formed on the surface of the corresponding one of the photosensitive drums 2 by the laser scanner unit 4, forming toner images on the surfaces of the photosensitive drums 2.

Next, primary transfer biases are applied to the primary transfer rollers 7, primarily transferring the toner images formed on the surfaces of the photosensitive drums 2 to the intermediate transfer belt 8 as a member to be subjected to the transferring process. Thus, a full-color toner image is formed on the surface of the intermediate transfer belt 8. The remaining toners on the surfaces of the photosensitive drums 2 after the primary transfer are scraped and removed with the cleaning blades 6.

Then, the intermediate transfer belt 8 moves around, conveying the toner image to the secondary transfer unit. A secondary transfer bias is applied to the secondary transfer roller 11 at the secondary transfer unit, transferring the toner image on the intermediate transfer belt 8 to the recording medium S.

Next, the recording medium S with the transferred toner image thereon is subjected to heating and pressing processing in the fixing unit 20. The toner image on the recording medium S thus is fixed to the recording medium S. Then, the recording medium S with the fixed toner image thereon is discharged onto a discharge unit 24 by a discharge roller 23 in the printer A.

<Configuration of Sheet Feed Tray 16>

Next, a configuration of the sheet feed tray 16 will be described. The sheet feed tray 16 includes an exterior cover 30 (a first member), which is a part of the exterior, and a conveyance cover 31 (a second member), which is the surface on which recording media S is put (FIG. 1A).

The exterior cover 30 constitutes an exterior surface, a part of the exterior, with the exterior cover 30 put in the image forming apparatus in place. The exterior cover 30 includes a lock unit that restricts the movement of the sheet feed tray 16 put in the main body of the image forming apparatus 1 in place with respect to the main body of the image forming apparatus 1, the lock unit of which is in engagement with a protrusion portion of the lock unit. The lock unit includes the protrusion portion, a spring (not illustrated) applying force to the protrusion portion to protrude from the exterior cover 30 (the sheet feed tray 16), and the lock lever 36, which reduces a protrusion length of the protrusion portion with respect to the conveyance cover 31 (the sheet feed tray 16) against the elastic force of the spring. In the lock unit, if the lock lever 36 is pressed, the protrusion portion is moved, releasing the engagement with the image forming apparatus 1, allowing the sheet feed tray 16 to move with respect to the main body of the image forming apparatus 1.

Figure 3:
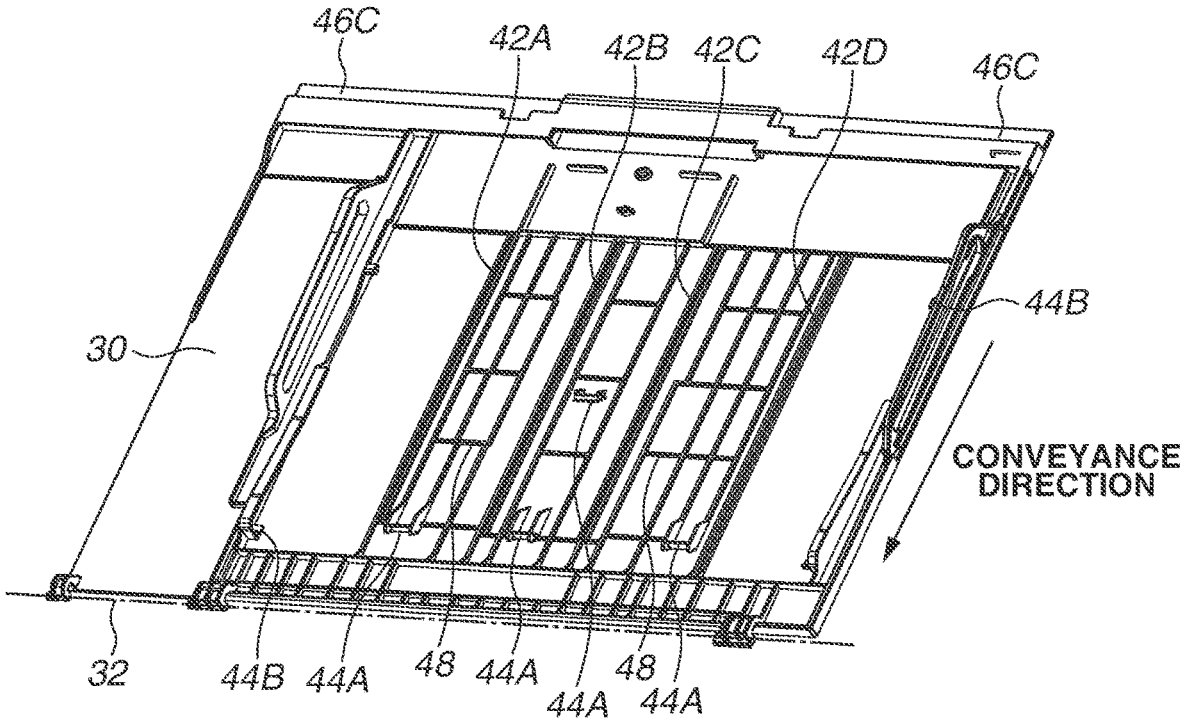
FIG. 3 is a schematic perspective view illustrating a configuration of an exterior cover according to an exemplary embodiment.

The exterior cover 30 includes a plurality of groove portions 42 (42A to 42D), a plurality of hook portions 44 (44A to 44C) each having a concave shape, and engagement ribs 48 on the surface opposite the exterior surface as illustrated in FIG. 3. According to the present exemplary embodiment, the groove portions 42 each are a groove between two ribs (first ribs) extending in parallel.

Figure 4A:
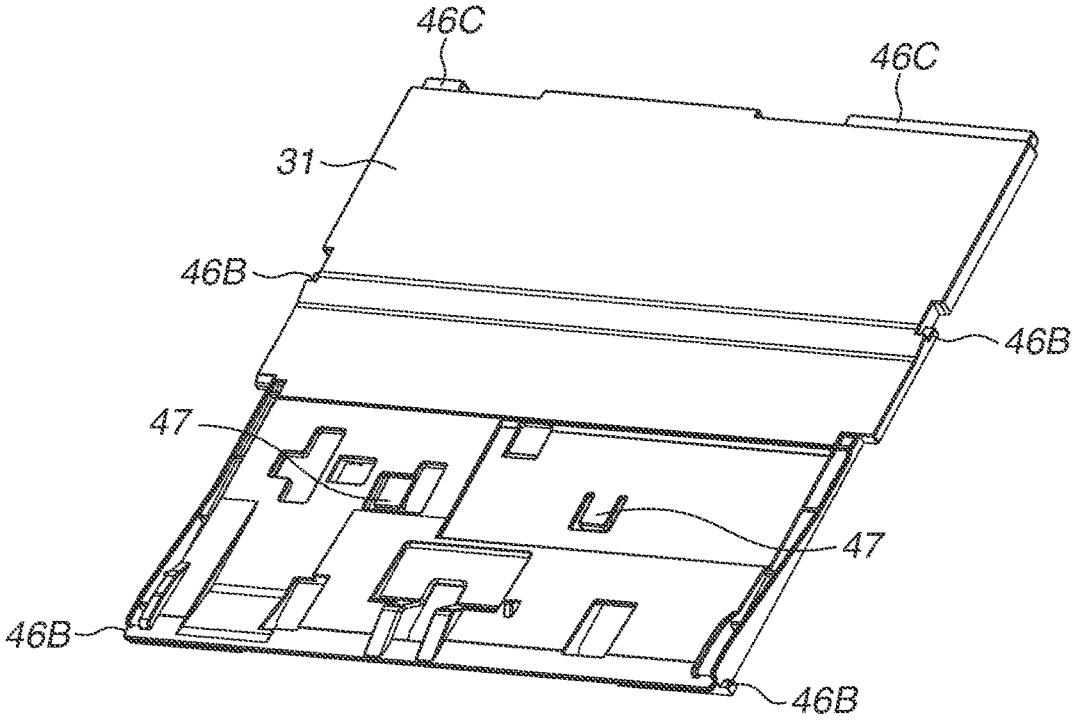
FIGS. 4A and 4B are schematic perspective views illustrating a configuration of a conveyance cover according to the exemplary embodiment.
Figure 4B:
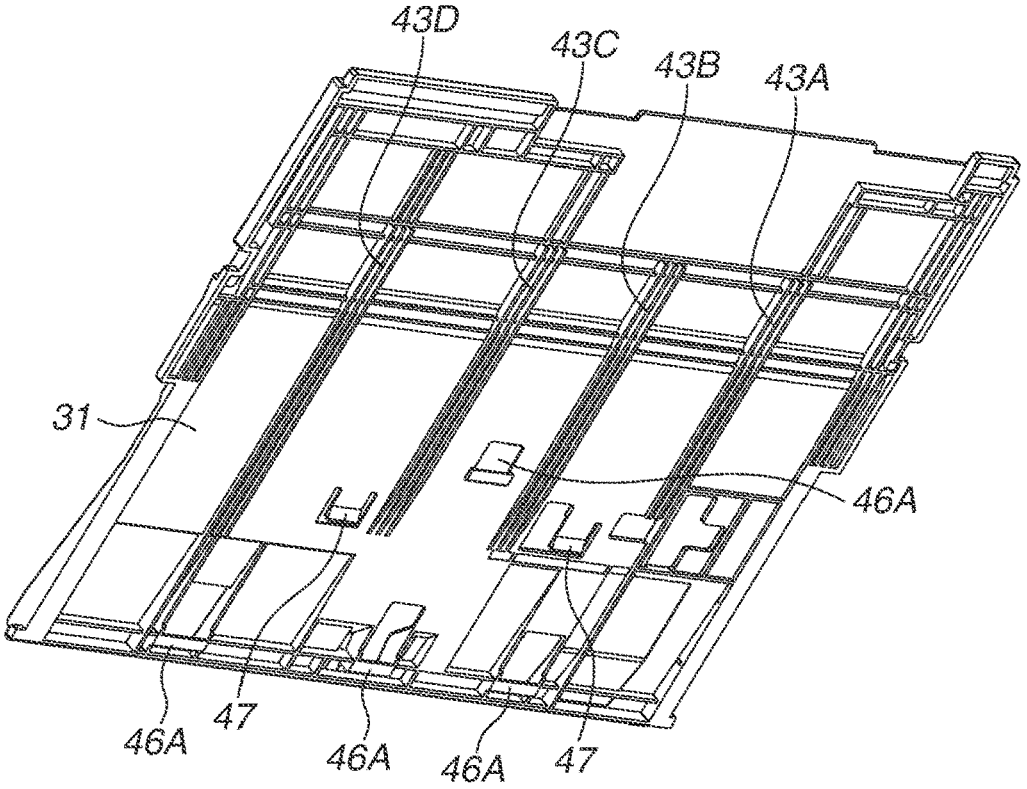

On the other hand, the conveyance cover 31 constitutes the surface on which recording media S are to be put while the conveyance cover 31 protrudes from the main body of the image forming apparatus 1. As illustrated in FIG. 4A, the conveyance cover 31 includes a plurality of engagement portions 46 (46A to 46C) on the surface on which recording media S are to be put. As illustrated in FIG. 4B, the conveyance cover 31 also includes a plurality of ribs 43 (43A to 43D, convex portions or second ribs) and a plurality of snap-fit portions 47 on the surface opposite the surface on which recording media S is to be put.

According to the present exemplary embodiment, the exterior cover 30 is integrated with the conveyance cover 31 with each of the ribs 43 fitted in and adhesively bonded to the corresponding one of the groove portions 42, forming the sheet feed tray 16. The groove portions 42 and the ribs 43 are provided to extend in the conveyance direction at intervals in the direction perpendicular to the conveyance direction of recording media S put on the sheet feed tray 16.

Adhesion using an adhesive typically has high strength in the shear direction along the adhesive surface but has low strength in the direction in which adhesive surfaces are peeled to be separated from each other. However, according to the present exemplary embodiment, the groove portions 42 and the ribs 43 fitted in the groove portions 42 respectively extend in the conveyance direction of recording media S on the sheet feed tray 16. In other words, in the groove portions 42 and the ribs 43 in the direction in which the exterior cover 30 faces the conveyance cover 31, each surface of the groove portions 42 adheres to the mating surface of the corresponding one of the ribs 43 opposite the surface of the corresponding groove portion (the bottom portion of the corresponding groove portion 42 and the mating rib 43). In addition, in the axial direction of the rotating shaft 32 and the direction opposite the axial direction, each surface of the groove portions 42 adheres to the mating surface of the corresponding one of the ribs 43 opposite the surface of the corresponding groove portion (the side surface 45 of the corresponding one of the groove portions 42 and the mating one of the ribs 43).

That means that the shear direction of the adhesive 40 between the bottom portion of each groove portion 42 and the corresponding rib 43 is the same as the direction of the exterior cover 30 and the conveyance cover 31 extending. A static load on the sheet feed tray 16 causes the exterior cover 30 and the conveyance cover 31 to bend together vertically downward. This applies force to the exterior cover 30 and the conveyance cover 31 in the direction in which the exterior cover 30 and the conveyance cover 31 are to be dislodged from each other, namely in the direction of the exterior cover 30 and the conveyance cover 31 extending. However, according to the above-described configuration, a static load on the sheet feed tray 16 generates the force between the exterior cover 30 and the conveyance cover 31 in the shear direction in which the adhesive strength of the adhesive 40 is high. Thus, even with a static load on the sheet feed tray 16, this configuration allows the adhesive 40 to hold the exterior cover 30 and the conveyance cover 31 fixed firmly.

Further, according to the above-described configuration, the force in the direction of the exterior cover 30 to be peeled separately from the conveyance cover 31 is in the shear direction of the adhesive 40 between each side surface 45 of the groove portions 42 and the corresponding one of the ribs 43. Even in this state, this configuration makes the direction of the exterior cover 30 to be peeled from the conveyance cover 31 the same as the shear direction in which the adhesive strength of the adhesive 40 is high, allowing the adhesive 40 to hold the exterior cover 30 and the conveyance cover 31 fixed firmly.

Thus, besides the axial direction of the rotating shaft 32 and the conveyance direction of recording media S on the sheet feed tray 16, the direction in which the exterior cover 30 faces the conveyance cover 31 is the same as the shear direction along the adhesive surfaces of the groove portions 42 and the ribs 43. As described above, the sheet feed tray 16 has a structure formed of the exterior cover 30 and the conveyance cover 31 in which each of the ribs 43 fitted in the corresponding one of the groove portions 42 adheres to the mating bottom portion of the corresponding one of the groove portions 42 and each side surface 45 of the groove portions 42 adheres to the corresponding one of the ribs 43 firmly.

Further, according to the present exemplary embodiment, the sheet feed tray 16 is formed by the exterior cover 30 being integrated with the conveyance cover 31 with each of the hook portions 44 in engagement with the corresponding one of the engagement portions 46 and each snap fit portion 47 in engagement with the corresponding one of the engagement ribs 48, in addition to the adhesion of the groove portions 42 to the ribs 43.

Figure 6A:
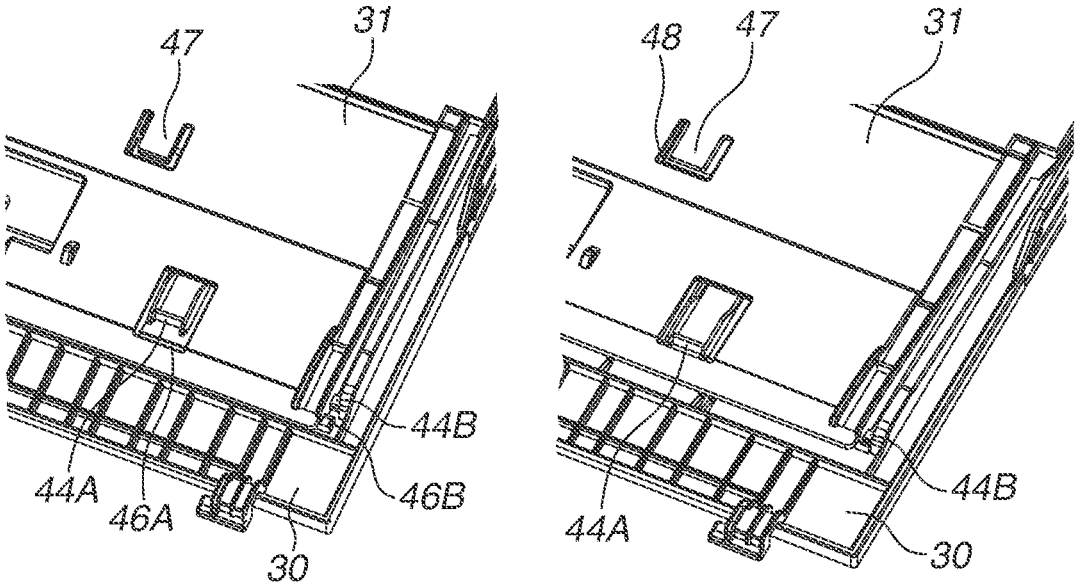
FIGS. 6A and 6B are schematic perspective views illustrating an engagement state between the exterior cover and the conveyance cover according to the exemplary embodiment.
Figure 6B:
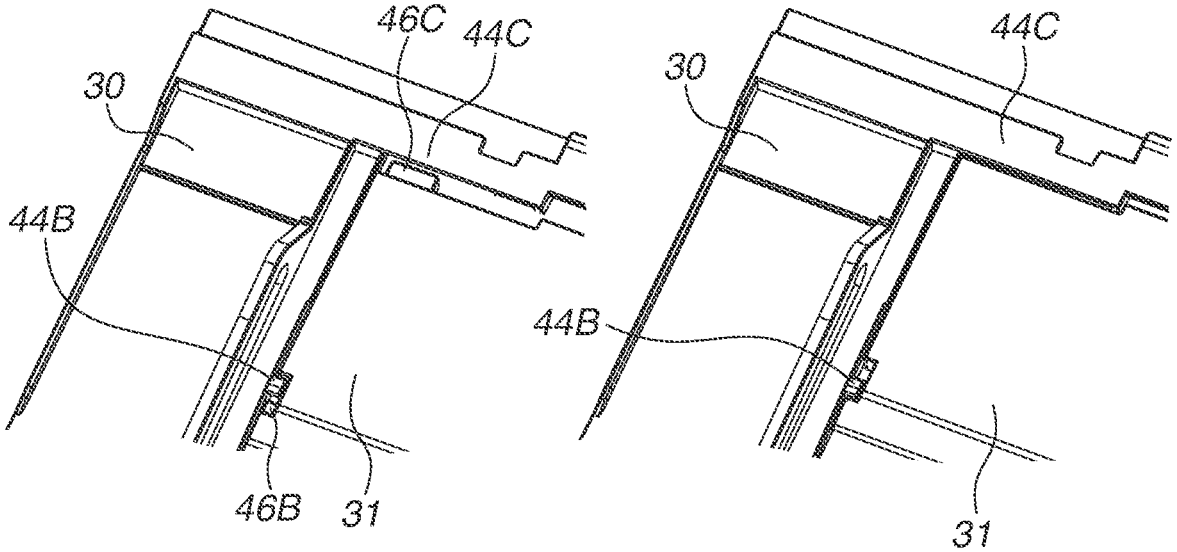

When the exterior cover 30 and the conveyance cover 31 are free without the adhesive 40, the conveyance cover 31 is slidable in one direction (in a first direction or in the direction opposite the first direction) with respect to the exterior cover 30. The conveyance cover 31 is slid to the one direction with respect to the exterior cover 30, putting each of the engagement portions 46 inside the corresponding one of the hook portions 44, restricting the movement of the conveyance cover 31 away from the exterior cover 30 (FIG. 6A). This configuration allows the conveyance cover 31 to be slid in the one direction with respect to the exterior cover 30 while the snap fit portions 47 are elastically deformed. Thus, the conveyance cover 31 is slid with respect to the exterior cover 30 until each of the engagement portions 46 put inside the corresponding one of the hook portions 44 having a concave shape comes into contact with the inner part of the hook portion 44 to restrict the movement in the one direction. Further, with the conveyance cover 31 slid with respect to the exterior cover 30, the elastic deformation amount of each snap fit portion 47 becomes zero (returns to the original shape) or is reduced (FIG. 6B). This allows each of the snap fit portions 47 to engage with the corresponding one of the engagement ribs 48, restricting the movement of the conveyance cover 31 in the direction opposite to the one direction in which the conveyance cover 31 is slid with respect to the exterior cover 30 (the direction opposite to the first direction).

As described above, according to the present exemplary embodiment, each of the hook portions 44 engages with the corresponding one of the engagement portions 46. The strength of the adhesive 40 is typically lower in the peeling direction than that in the shear direction. However, in the above described configuration, each of the hook portions 44 engages with the corresponding one of the engagement portions 46, bearing the force in the peeling direction of the adhesive 40 between each bottom portion of the groove portions 42 and the corresponding one of the ribs 43, namely, in the direction of the exterior cover 30 to be separated from the conveyance cover 31.

As described above, the exterior cover 30 and the conveyance cover 31 are not dislodged from each other even if external force is applied to them in the direction perpendicular to the axial direction of the rotating shaft 32, the conveyance direction of the recording medium S on the sheet feed tray 16, and the directions in which the exterior cover 30 and the conveyance cover 31 face each other. As a result, the sheet feed tray 16 has an increased rigidity, preventing the sheet feed tray 16 from being deformed in a twisted way even with eternal force applied to the sheet feed tray 16.

In addition, if the exterior cover 30 and the conveyance cover 31 are made of thin-walled molded components, the above described configuration allows the structure to have rigidity similar to that of a conventional configuration, leading to a lighter weight of the sheet feed tray 16. The sheet feed tray 16 with a lighter weight is movable by weaker force used in the operation of moving the sheet feed tray 16 to open or close it. Further, even if the sheet feed tray 16 is moved by its own weight, the impact and noise occurring when the rotation of the links 33A and 33B with the rotation of the sheet feed tray 16 around the rotating shaft 32 is stopped are reduced due to the lighter weight of the sheet feed tray 16.

Besides, the sheet feed tray 16 formed of the two molded components, the exterior cover 30 and the conveyance cover 31, integrated by adhesion has a configuration with no screws or hooks visible to users. This allows the image forming apparatus 1 to include a flat exterior surface, in a non-concavo-convex shape. The flat exterior surface prevents recording media S being placed thereon from getting caught by concave or convex shapes, and with the flat exterior surface, the sheet feed tray 16 becomes excellent in usability.

<Assembly of Sheet Feed Tray 16>

An assembly process of the sheet feed tray 16 will be described with reference to FIGS. 5A, 5B, 6A, and 6B.

Figure 5A:
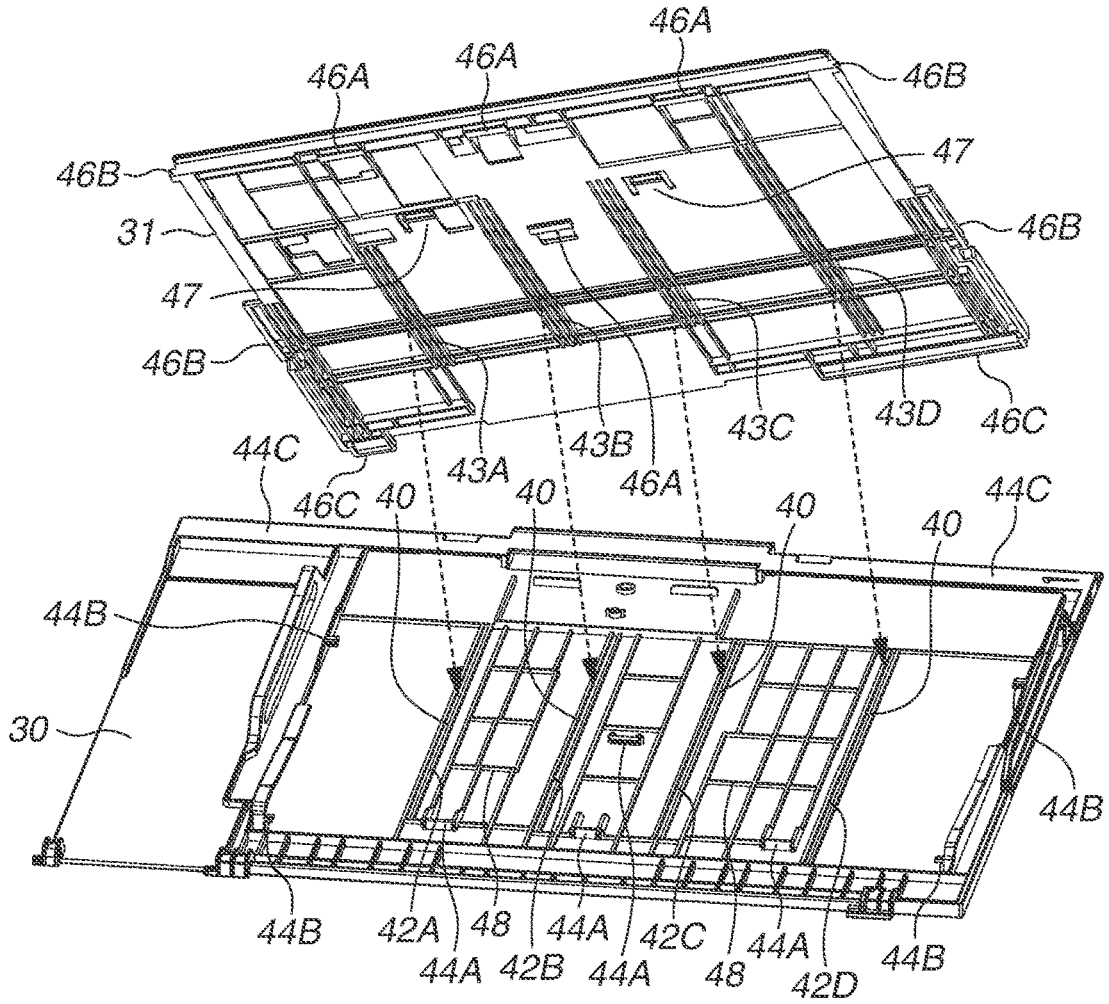
FIGS. 5A and 5B are schematic perspective views illustrating a configuration of a sheet feed tray according to the exemplary embodiment.
Figure 5B:
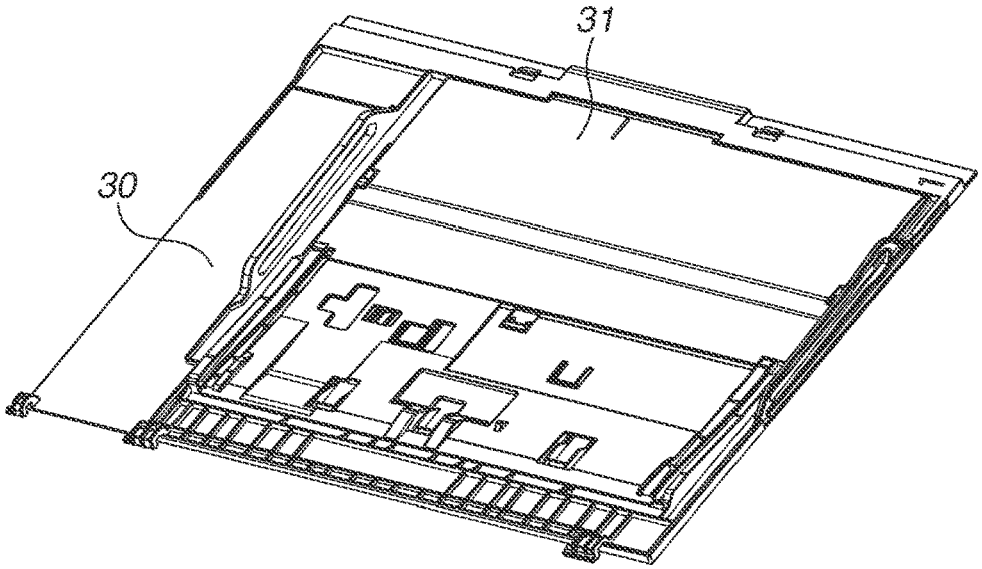

FIGS. 6A and 6B are schematic partial cross-sectional views illustrating a partial schematic configuration of FIG. 5A illustrating an adhesive bonding process of the exterior cover 30 and the conveyance cover 31 using the adhesive 40. The sheet feed tray 16 is formed in such a manner that the adhesive 40 is applied to the exterior cover 30, then the exterior cover 30 is integrated with the conveyance cover 31, and they are adhesively bonded to each other.

Figure 7A:
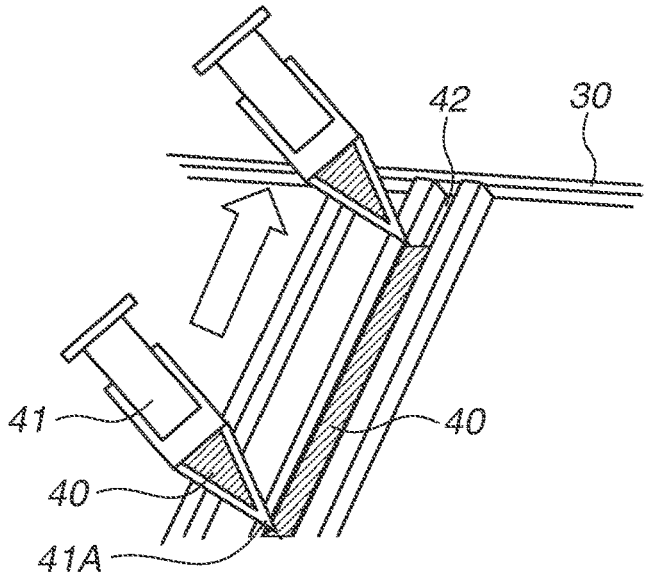
FIGS. 7A to 7C are schematic perspective views illustrating an adhesive bonding process on the exterior cover and the conveyance cover according to the exemplary embodiment.

First, as illustrated in FIG. 7A, an application process is performed in which a nozzle 41A on an adhesive application device 41 is put in the groove portion 42 in a groove shape in the exterior cover 30 and ejects adhesive 40. According to the present exemplary embodiment, the adhesive 40 is linearly applied to four groove portions 42A to 42D in the exterior cover 30 in the conveyance direction. The adhesive 40 may be any adhesive as long as it lies in a continuous linear shape at the time of adhesive bonding. The adhesive 40 may be applied to a plurality of places or in dots other than being linearly applied. Further, according to the present exemplary embodiment, the adhesive 40 is linearly applied, but how to apply the adhesive is not limited to the above-described examples. The adhesive 40 may be applied in a curved shape or in a shape in which a plurality of straight lines is connected into a line at a bending portion.

According to the present exemplary embodiment, a two component acrylic adhesive with a viscosity of about 3,000 to 15,000 pascal-second [Pa·s] is used as the adhesive 40, but a one component adhesive may be used. If a two component acrylic adhesive is used as the adhesive 40, the two liquids are mixed in advance in the adhesive application device 41, and then a predetermined amount of the adhesive 40 is ejected from the tip end of the nozzle 41A.

Figure 7B:
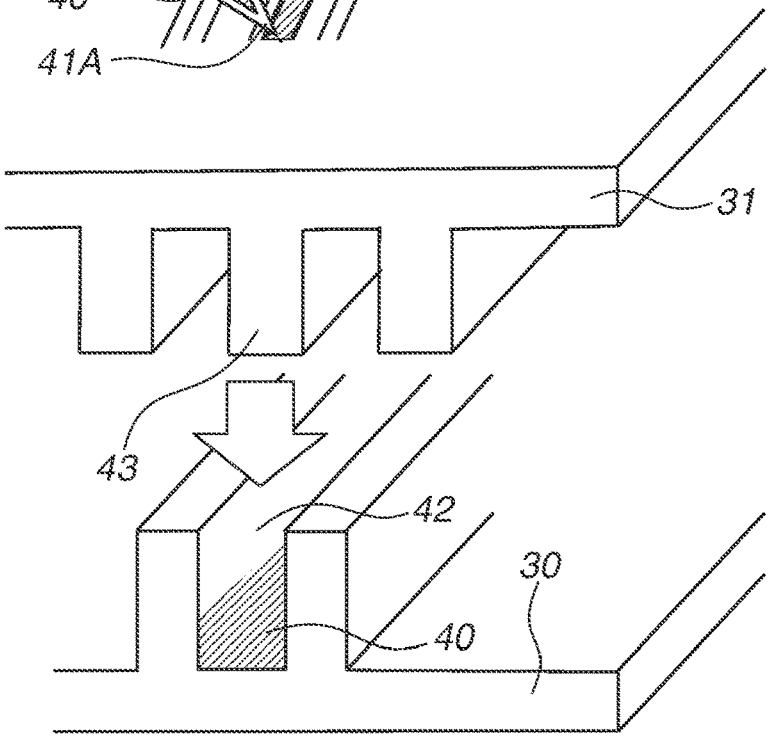
Figure 7C:
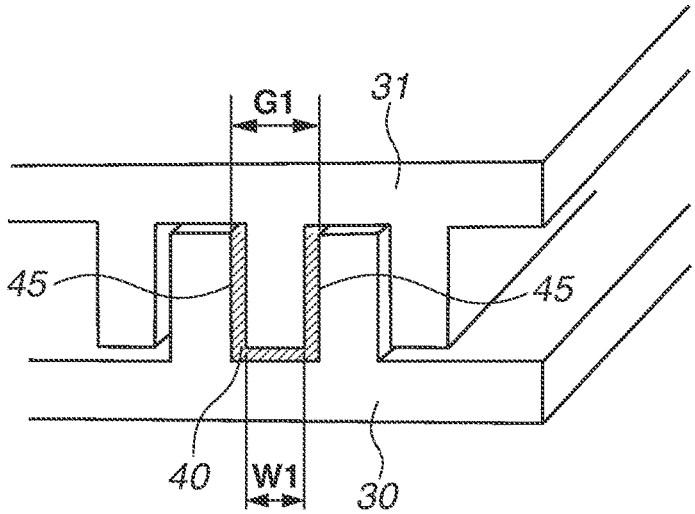

Next, as illustrated in FIG. 7B, an assembly process is performed in which the conveyance cover 31 and the exterior cover 30 are superimposed on each other with the rib 43 on the conveyance cover 31 fitted in the groove portion 42 in the exterior cover 30. In this assembly, the adhesive 40 is put between the rib 43 on the conveyance cover 31 and the groove portion 42 in a concave shape consisting of two ribs and the bottom portion connecting the two ribs and opposite to the opening (FIG. 7C). In other words, the tip end of the rib 43 on the conveyance cover 31 is surround by the adhesive 40. According to the present exemplary embodiment, the rib 43 has a width W1 of 1.6 mm, and the groove portion 42 has a gap G1 (a distance between the ribs) of about 2.4 mm. The amount of the adhesive 40 to be applied to the entire groove portion 42 in a groove form is properly calculated through calculation of the volume of the groove interior of the groove portion 42.

According to the present exemplary embodiment, the assembly process includes a temporary assembly process in which the conveyance cover 31 is slid with respect to the exterior cover 30 to engage with the exterior cover 30 after the conveyance cover 31 and the exterior cover 30 are superimposed. The conveyance cover 31 is slid in the one direction for each of the hook portions 44 to engage with the corresponding one of the engagement portions 46 before the adhesive 40 cures with the ribs 43 in the groove portions 42. The engagement of the engagement portions 46, which have been put in the hook portions 44, with the hook portions 44 restricts the movement of the conveyance cover 31 apart from the exterior cover 30. This allows the conveyance cover 31 to be slid with respect to the exterior cover 30 in the one direction with the snap-fit portions 47 in deformed shapes. The conveyance cover 31 is slid in the one direction with respect to the exterior cover 30 until the engagement portions 46 comes into contact with the inner ends of the hook portions 44, restricting the movement in the one direction, which brings the elastic deformation amounts of the snap fit portions 47 to be zero or be reduced. As described above, the sheet feed tray 16 is assembled through the assembly process of the exterior cover 30 being integrated with the conveyance cover 31.

In the application process of the adhesive 40, the adhesive 40 is ejectable with the nozzle 41A of the adhesive application device 41 put in the groove portion 42. This makes where to eject the adhesive 40 clear, facilitating the application process, reducing errors in where to eject or the application outside the application ranges. In addition, application of the adhesive 40 to the groove portions 42 in groove shapes prevents the adhesive 40 from flowing out of the bonding portions between the exterior cover 30 and the conveyance cover 31, ensuring adhesion with a small amount of adhesive.

Further, in the assembly process of the exterior cover 30 and the conveyance cover 31, the ribs 43 on the conveyance cover 31 are fitted in the groove portions 42 in the exterior cover 30. This makes the alignment of the exterior cover 30 and the conveyance cover 31 easy, reducing errors in bonding portions. In addition, according to the present exemplary embodiment, the gap G1 of the groove portions 42 is set to as narrow as about 2.4 mm whereas the width W1 of the ribs 43 is 1.6 mm, ensuring that the adhesive 40 lies between the conveyance cover 31 and the exterior cover 30 even though the amount of the adhesive 40 used is small. Further, according to the present exemplary embodiment, the viscosity of the adhesive 40 is set to about 3,000 to 15,000 [Pa·s], allowing the adhesive 40 to go into the gap between the groove portions 42 and the ribs 43 in a capillary phenomenon. As a result, the adhesive 40 lies throughout the gap between the conveyance cover 31 and the exterior cover 30, surrounding the tip ends of the ribs 43.

The temporary assembly process in the assembly process brings the elastic deformation amounts of the snap-fit portions 47 to be zero (recovery into the original shapes) or be reduced with the movement in the one direction restricted through engagement of the hook portions 44 with the engagement portions 46. In other words, the condition that the movement in the one direction is restricted through the engagement of the hook portions 44 with the engagement portions 46 makes it possible for the snap-fit portions 47 and the engagement ribs 48 to engage, allowing the movement in the other direction to be restricted. As described above, the hook portions 44 and the snap-fit portions 47 are temporarily fixed to the engagement portions 46 and the engagement ribs 48, respectively, preventing the movement in the one direction and in the other direction opposite to the one direction, preventing the exterior cover 30 from coming off the conveyance cover 31. This eliminates the need for holding the exterior cover 30 and the conveyance cover 31 with clamps or other tools until the adhesive 40 applied between the exterior cover 30 and the conveyance cover 31 cures to have a sufficient strength.

Modifications

Figure 8:
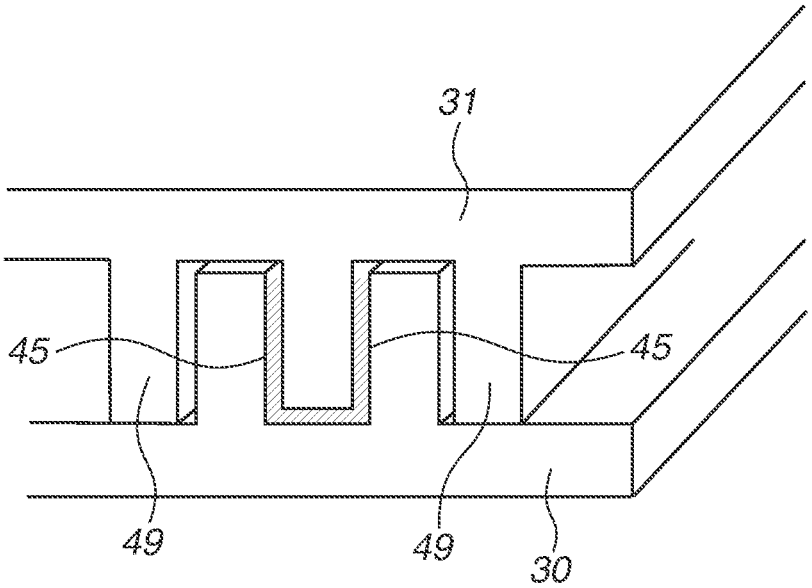
FIG. 8 is a schematic perspective view illustrating an adhesive bonding process on an exterior cover and a conveyance cover according to a modification.

According to the present exemplary embodiment, the ribs forming the groove portions 42 in the exterior cover 30 are provided to come into contact with the conveyance cover 31 while each of the ribs 43 is put in the corresponding one of the groove portions 42 with a certain length of the rib 43 put in, making the thickness of the adhesive 40 between the tip ends of the ribs 43 and the bottom portions of the groove portions 42 appropriate. However, the configuration is not limited to this. As illustrated in FIG. 8, ribs 49 substantially parallel to the ribs 43 may be provided on the conveyance cover 31 to make the tip ends of the ribs 49 come into contact with the exterior cover 30, as a modification. As described above, the tip ends of the ribs 43 put between the ribs 49 out of contact with the exterior cover 30 with a certain length of each tip end put in causes the thickness of the adhesive 40 between the tip ends of the ribs 43 and the bottom portions of the groove portions 42 to be appropriate.

The configuration has been described of the sheet feed tray in the image forming apparatus formed of the two molded components adhesively bonded to each other, which produces various effects. However, the embodiments are not limited to the configuration. The above-described configuration applied to other optional apparatuses accompanying the image forming apparatus, a sheet feed tray of an image reading apparatus, and a sheet discharge tray of a sheet discharge apparatus and a post-processing apparatus has similar effects.

In addition, according to the above-described exemplary embodiments, the exterior cover 30 and the conveyance cover 31 are provided with the plurality of groove portions 42 (42A to 42D) and the plurality of ribs 43 (43A to 43D), respectively, but the embodiments are not limited to this configuration. The exterior cover 30 and the conveyance cover 31 may be provided with the plurality of ribs 43 (43A to 43D) and the plurality of groove portions 42 (42A to 42D), respectively. The configuration can be appropriately modified within the scope of the present disclosure.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-111973, filed Jun. 29, 2020, which is hereby incorporated by reference herein in its entirety.

What is claimed is:

1. An image forming apparatus comprising:

a main body including an image forming unit configured to form an image on a recording medium; and a tray configured to rotate between an open state and a closed state with respect to the main body, the tray on which the recording medium is placed, wherein the tray includes a first component as a part of an exterior of the image forming apparatus in the closed state and a second component configured to be in contact with the recording medium placed on the tray in the open state, wherein one of the first component and the second component includes at least one groove portion which extends in a conveyance direction of the recording medium and the other of the first component and the second component includes at least one convex portion which extends in the conveyance direction, wherein the first component and the second component are bonded by adhering, with an adhesive, the at least one convex portion which is put inside the at least one groove portion and the at least one groove portion.

2. The image forming apparatus according to claim 1, wherein the at least one groove portion is formed of two first ribs extending in parallel in the conveyance direction, and wherein the at least one convex portion is a second rib extending in the conveyance direction.

3. The image forming apparatus according to claim 2, wherein the two first ribs are in contact with the other of the first component and the second component.

4. The image forming apparatus according to claim 1, wherein the at least one groove portion includes a plurality of groove portions and the at least one convex portion includes a plurality of convex portions, and wherein the plurality of groove portions and the plurality of convex portions extend in the conveyance direction and are provided at intervals in a direction perpendicular to the conveyance direction.

5. The image forming apparatus according to claim 1, wherein the first component and the second component are configured to be integrated until the adhesive cures.

6. The image forming apparatus according to claim 5, further comprising:

a hook portion on the one of the first component and the second component;

an engagement rib on the one of the first component and the second component;

an engagement portion on the other of the first component and the second component; and a snap fit portion on the other of the first component and the second component, wherein, in a state in which the hook portion and the engagement portion restrict movement of the one of the first component and the second component away from the other of the first component and the second component, movement of the one of the first component and the second component in a first direction is restricted by the hook portion and the engagement portion, movement of the one of the first component and the second component in a direction opposite to the first direction is restricted by the engagement rib and the snap fit portion, and the first component and the second component are maintained in an integrated state.

7. The image forming apparatus according to claim 1, wherein the tray is a sheet feeding tray on which a recording medium to be conveyed to the image forming unit is to be placed, and the conveyance direction is a sheet feeding direction of the recording medium.

8. The image forming apparatus according to claim 1, wherein the tray is a sheet discharge tray on which a recording medium on which the image is formed by the image forming unit is to be placed, and the conveyance direction is a sheet discharge direction of the recording medium.

9. A method of manufacturing an image forming apparatus, the method comprising:

applying an adhesive to an inside of a groove portion included in a first component and extending in a predetermined direction;

manufacturing a tray by inserting a convex portion included in a second component and extending in the predetermined direction into the groove portion and bonding the groove portion and the convex portion with the adhesive, the tray on which a recording medium is placed; and attaching the tray to a main body including an image forming unit configured to form an image on the recording medium, wherein the predetermined direction is a conveyance direction of the recording medium in a state in which the tray is attached to the main body.

10. The method according to claim 9, further comprising temporarily assembling to integrate the first component and the second component until the adhesive cures after inserting the convex portion into the groove portion and superimposing the first component and the second component.

11. The method according to claim 10, wherein the image forming apparatus includes:

a hook portion on one of the first component and the second component;

an engagement rib on the one of the first component and the second component;

an engagement portion on the other of the first component and the second component; and a snap fit portion on the other of the first component and the second component, wherein, in a state in which the hook portion and the engagement portion restrict movement of the one of the first component and the second component away from the other of the first component and the second component, the temporarily assembling includes attaching the one of the first component and the second component to the other by moving the one of the first component and the second component to a predetermined position while elastically deforming the snap fit portion, where the predetermined position is a position at which movement of the one of the first component and the second component in a first direction is restricted by the hook portion and the engagement portion, and wherein, in the temporarily assembling, movement of the one of the first component and the second component in a direction opposite to the first direction is restricted by the engagement rib and the snap fit portion, whereby the first component and the second component are maintained in an integrated state.

12. The method according to claim 9, wherein the tray is a sheet feeding tray on which a recording medium to be conveyed to the image forming unit is to be placed, and the conveyance direction is a sheet feeding direction of the recording medium.

13. The method according to claim 9, wherein the tray is a sheet discharge tray on which a recording medium on which an image is formed by the image forming unit is to be placed, and the conveyance direction is a sheet discharge direction of the recording medium.

* * * * *